US009995142B2

(12) United States Patent
Chen

(10) Patent No.: US 9,995,142 B2
(45) Date of Patent: Jun. 12, 2018

(54) ROTOR OF A ROTARY CYLINDER

(71) Applicant: Pei Chen Lu, Taichung (TW)

(72) Inventor: Yung Chuan Chen, Taichung (TW)

(73) Assignee: Pei Chun Lu, Taichung (TW)

( * ) Notice: Subject to any disclaimer, the term of this patent is extended or adjusted under 35 U.S.C. 154(b) by 180 days.

(21) Appl. No.: 15/168,210

(22) Filed: May 30, 2016

(65) Prior Publication Data

US 2017/0022812 A1 Jan. 26, 2017

(30) Foreign Application Priority Data

Jul. 21, 2015 (TW) ..... 104211701 U

(51) Int. Cl.
*F01C 21/08* (2006.01)
*F01C 19/00* (2006.01)

(52) U.S. Cl.
CPC ..... *F01C 21/0809* (2013.01); *F01C 19/005* (2013.01); *F04C 2240/20* (2013.01); *F05B 2240/20* (2013.01)

(58) Field of Classification Search
CPC .. F15B 15/12; F15B 15/1452; F01C 21/0809; F16J 15/3232
USPC ..... 92/125
See application file for complete search history.

(56) References Cited

U.S. PATENT DOCUMENTS 3,359,870 A * 12/1967 Purcell ..... F15B 15/12 92/125
3,890,885 A * 6/1975 Nash ..... F16J 15/545 92/125
4,784,047 A * 11/1988 Stoll ..... F15B 15/12 92/125
8,573,558 B2 * 11/2013 Wang ..... F15B 15/12 92/121
8,671,672 B2 * 3/2014 Wang ..... F15B 15/12 92/121

* cited by examiner

*Primary Examiner* — Michael Leslie
(74) *Attorney, Agent, or Firm* — Rosenberg, Klein & Lee

(57) ABSTRACT

A rotor for a rotary cylinder includes a body having a tube and a plate which has the first end integrally formed to the tube, and the second end of the plate extends radially relative to the tube. The plate is a solid plate and has a curved outer periphery. A first recessed area is defined in each of the top and the bottom of the plate. A waist is formed to the plate and located between the first and second ends of the plate. A resilient coat is coated to the body and includes a Y-shaped seal portion along the curved outer periphery of the plate so as to be movably in contact with the inside of the cylinder.

9 Claims, 9 Drawing Sheets

B-B SECTION

ROTOR OF A ROTARY CYLINDER

BACKGROUND OF THE INVENTION

1. Fields of the invention

The present invention relates to a rotor of a rotary cylinder, and more particularly, to an improvement for the rotor of a rotary cylinder.

2. Descriptions of Related Art

The conventional rotary cylinder 9 known to applicant is disclosed in FIGS. 7 and 8, and comprises a cylinder 91 with a chamber 92 defined therein, and a rotor 93 is rotatably located within the chamber 92 so as to define a first room 921 and a second room 922 in the chamber 92. Pressure is applied in the first room 921 or the second room 922 to rotate the rotor 93.

In order to ensure that the rotor 93 is operated as expected, a resilient coat 932 is coated to the body 931 of the rotor 93. The resilient coat 932 forms a Y-shaped seal portion 933 which contacts the inside of the cylinder 91. The seal portion 933 includes two lips 934 and each lip 934 is supported by a resilient member 936 which is located in a recess 935 located at a distance from the lip 934, such that the resilient members 936 push the two lips 934 toward the inside of the cylinder 91. Besides, two covers 94 are connected to the rotor 93 by a fastening member 95 to prevent the two resilient members 936 from dropping from the recesses 936.

Generally, for saving the material for the body 931, the body 931 is a hollow body as shown in FIG. 9, and has a side panel 938 which is connected to one open side of the body 931 so as to seal the space 937 in the hollow body. The resilient coat 932 is applied to the outside of the rotor in a mold set. However, the resilient material of the resilient coat 932 can easily flow into the space 937 via gaps between the side panel 937 and the open side of the body 931, such that the resilient coat 932 cannot be completely coated to the body 931 as expected.

It is noted that there are multiple small parts are involved, such as the resilient members 936, the covers 94, and the side panel 938, all of these parts increase difficulties of assembly. The coating processes of the resilient coat 932 also make a lot of problems.

The present invention intends to provide an improvement to the rotor to eliminate the shortcomings mentioned above.

SUMMARY OF THE INVENTION

The present invention relates to a rotor for a rotary cylinder, and comprises a body having a tube and a plate which has a first end integrally formed to the tube. A second end of the plate extends radially relative to the tube. The plate is a solid plate and has a curved outer periphery. A first recessed area is defined in each of the top and the bottom of the plate. A waist is formed to the plate and located between the first and second ends of the plate. A resilient coat is coated to the body and includes a Y-shaped seal portion along the curved outer periphery of the plate.

Preferably, two protrusions extend from each of the two first recessed areas.

Preferably, the tube has two slots defined therein.

Preferably, the seal portion includes two lips and a connection portion which is connected between the two lips. Each lip has a narrow top and a wide root portion. Each lip has a tapered face which faces the first recessed area corresponding thereto.

Preferably, the thickness of the resilient coat is between 0.5 mm to 5 mm.

Preferably, the ratio between the thickness of the body 1 and the outer diameter of the tube of the rotary cylinder is between ¼ to ½.

The advantages of the present invention are that the rotor is a single piece and the body of the rotor is coated with a resilient coat. The body is not a hollow body so that when coating the resilient coat, the material of the resilient coat does not flows into the interior of the body as disclosed for the conventional rotor.

The thickness of the seal portion of the present invention is thicker than that of the conventional rotor so as to snugly contact the inside of the cylinder. Each of the lips has a tapered face which is applied by the pressure in the cylinder so as to further seal the inside of the cylinder.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
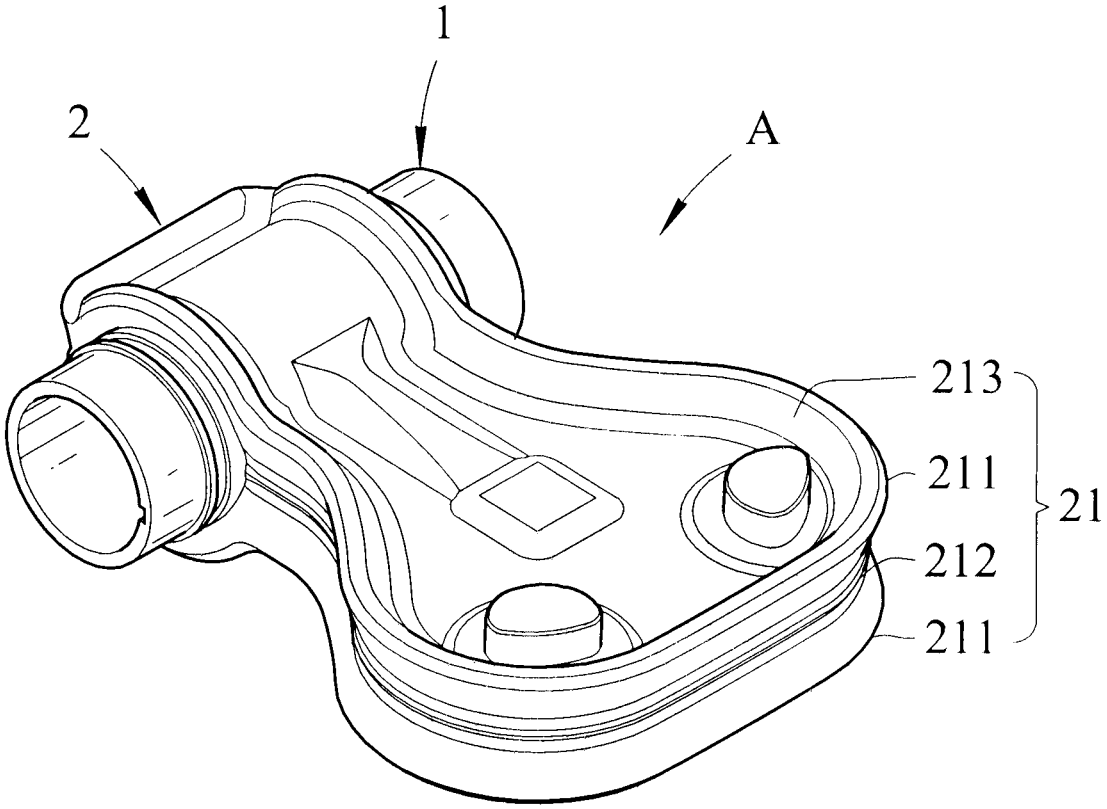
FIG. 1 is a perspective view to show the rotor of the present invention.
Figure 2:
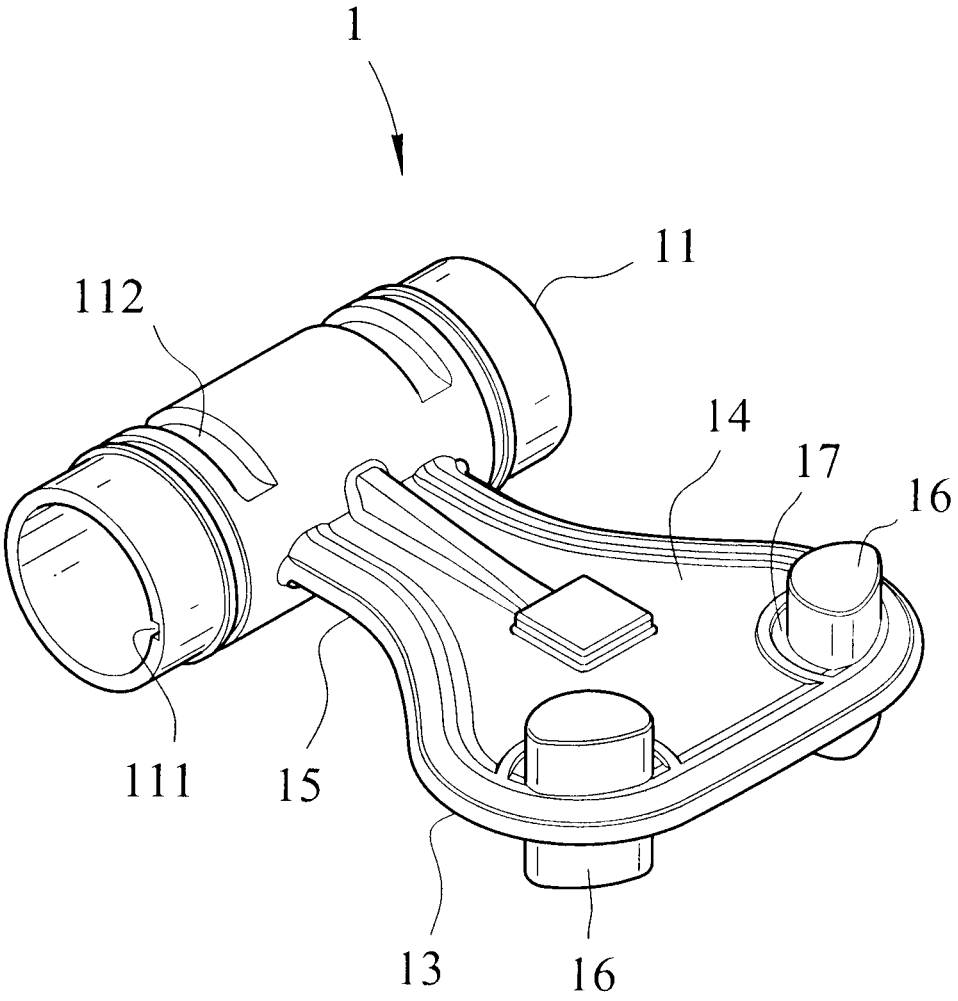
FIG. 2 is a perspective view to show the body of the rotor of the present invention.
Figure 3:
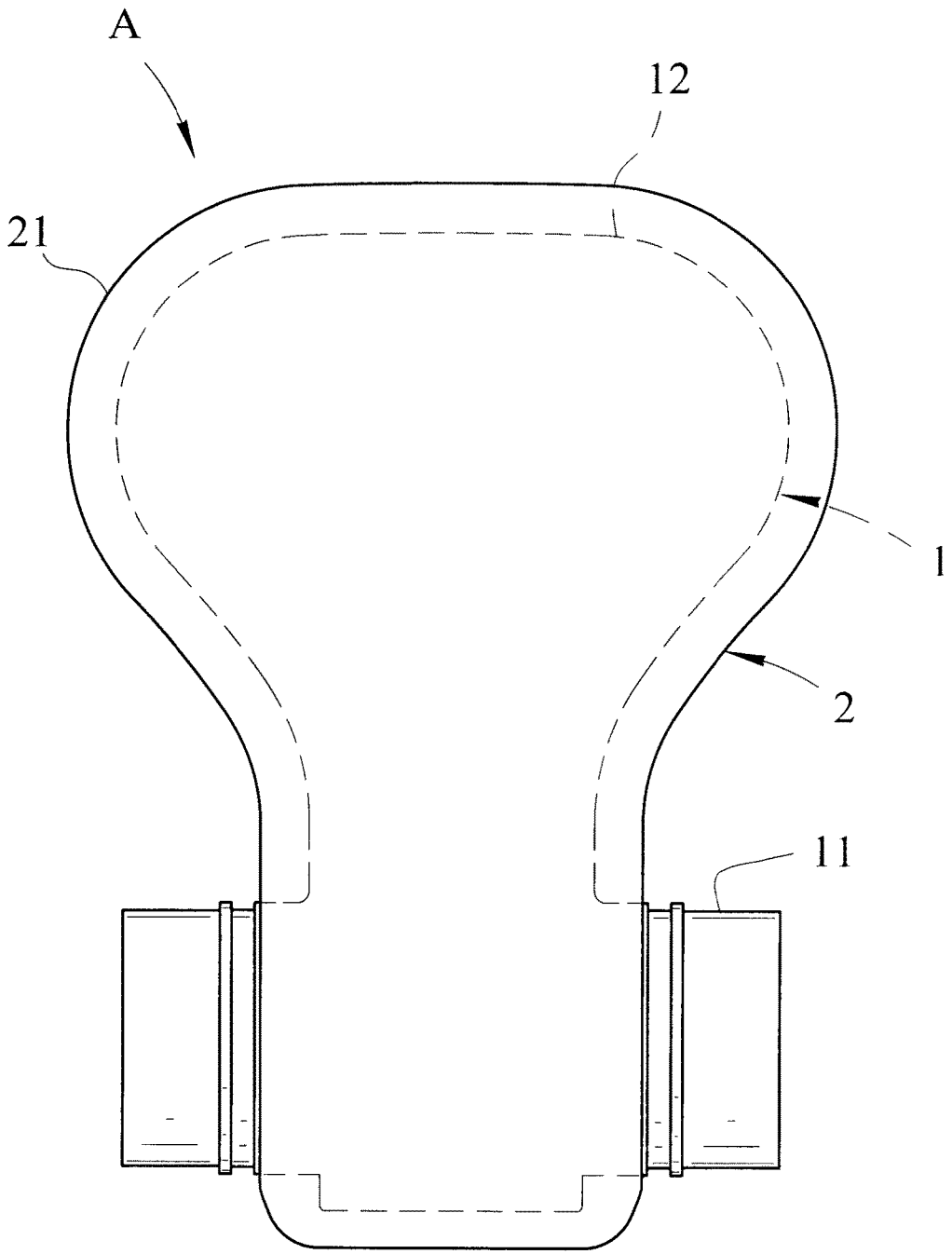
FIG. 3 is a top view to illustrate that the resilient coat is coated to the body of the rotor of the present invention.

Referring to FIGS. 1 to 4, the rotor "A" for a rotary cylinder of the present invention comprises a body 1 having a tube 11 and a plate 12 which has a first end integrally formed to the tube 11, and a second end of the plate 12 extends radially relative to the tube 11. The plate 12 is a solid plate and has a curved outer periphery 13. A first recessed area 14 is defined in each of the top and the bottom of the plate 12. A waist 15 having a narrower width compared with the second end of the plate 12 is formed to the plate 12 and located between the first and second ends of the plate 12. Two protrusions 16 extend from each of the two first recessed areas 14. The length "L" between two respective top face of the two protrusions 16 of the top and the bottom of the plate 12 is substantially the same as the outer diameter "d" of the tube 11 as shown in FIG. 5. Two second recessed areas 17 are defined in each of the first recessed areas 14, and each of the second recessed areas 17 has one of the protrusions 16 extending therefrom. The area of each of the second recessed areas 17 is larger than the cross sectional area of the protrusion 16 corresponding thereto. A rib 18 extends from one of the two first recessed areas 14.

A keyway 111 is defined axially in the inside of the tube 11 and located corresponding to the first end of the plate 12. The tube 11 has two slots 112 defined therein. The ratio between the thickness "T" of the body 1 and an outer diameter "d" of the tube 11 of the rotary "A" is between ¼ to ½.

Figure 4:
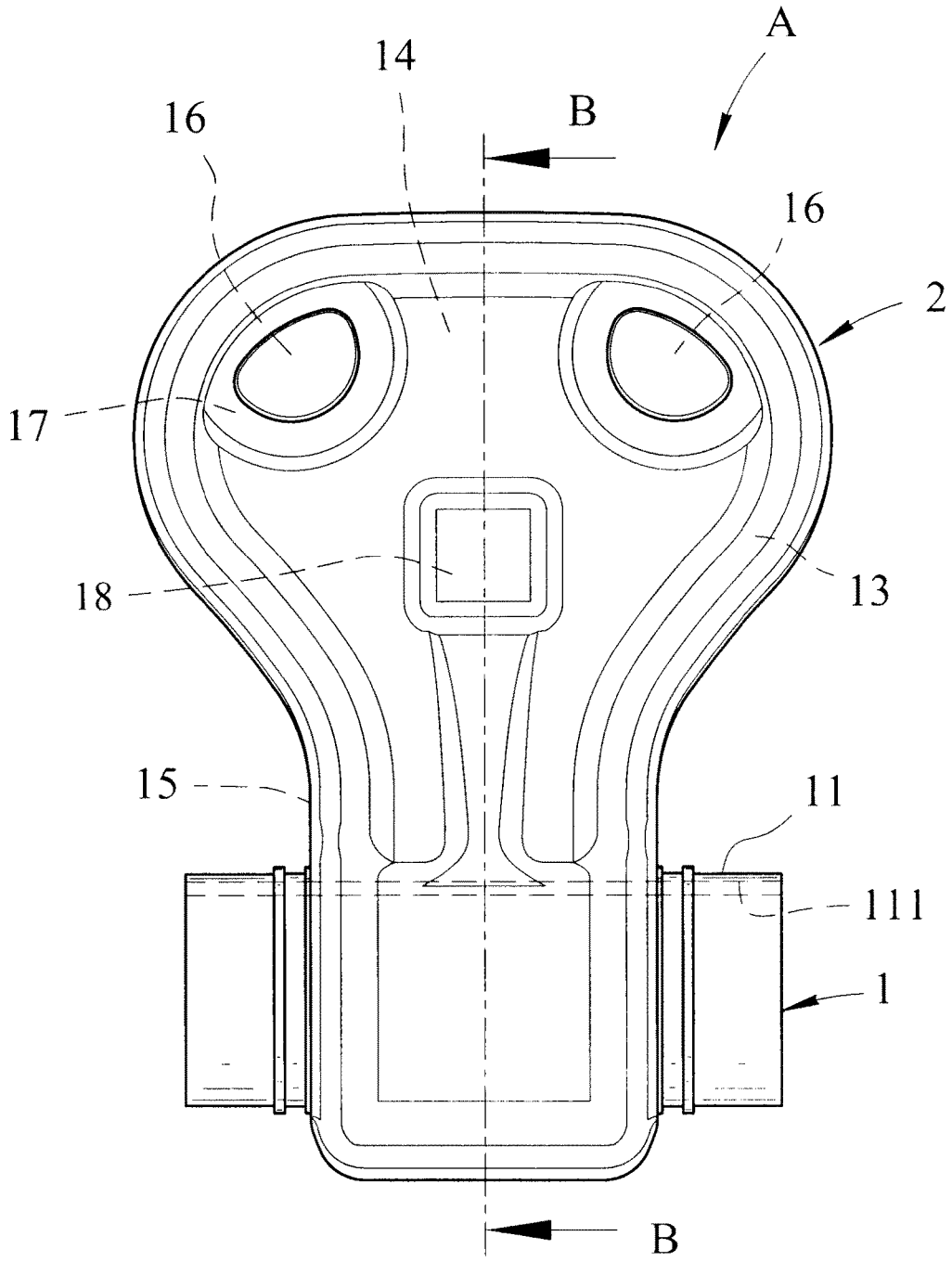
FIG. 4 is a top view of the rotor of the present invention.
Figure 5:
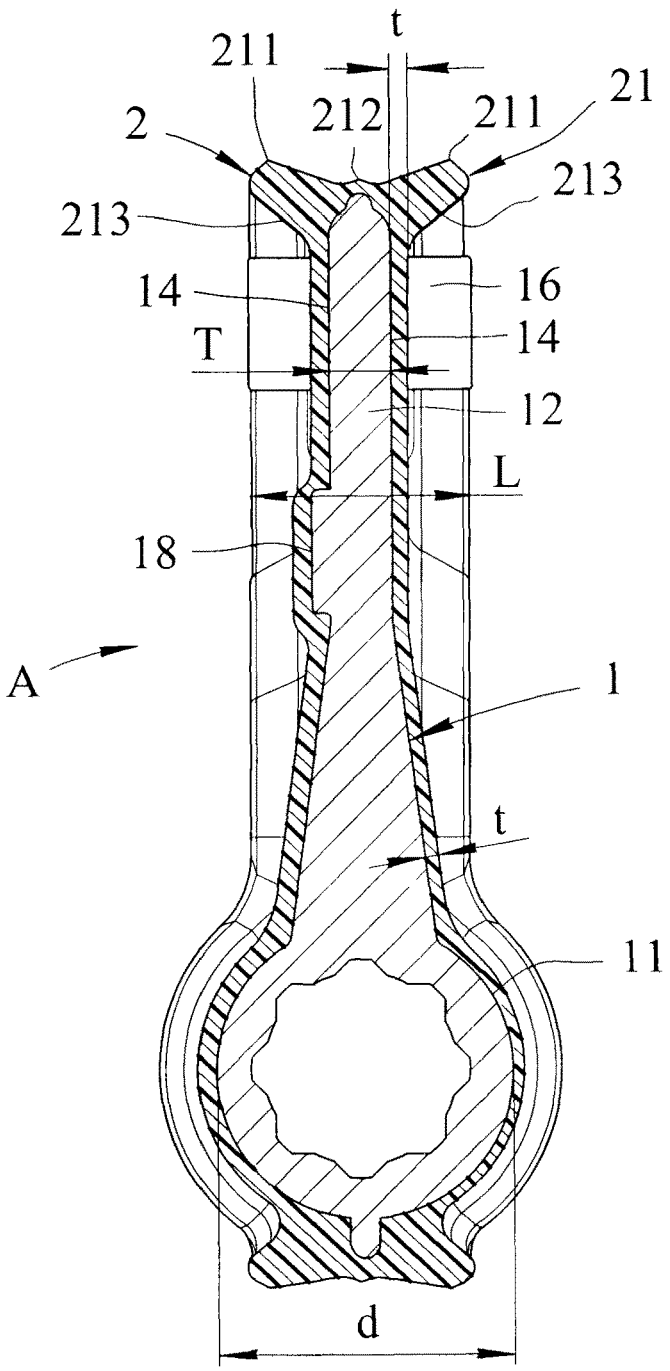
FIG. 5 is a cross sectional view, taken along line B-B in FIG. 4.

A resilient coat 2, as shown in FIGS. 4 and 5, is coated to the body 1 and includes a Y-shaped seal portion 21 along the curved outer periphery 13 of the plate 12. The seal portion 21 includes two lips 211 and a connection portion 212 which is connected between the two lips 211. The connection portion 212 is a ridge as shown in FIG. 5, so that the two lips 211 and the connection portion 212 form a W-like shape as disclosed in FIG. 5. Each lip 211 has a narrow top and a wide root portion. Each lip 211 has a tapered face 213 which faces the first recessed area 14 corresponding thereto. The thickness "t" of the resilient coat 2 is between 0.5 mm to 5 mm.

Figure 6:
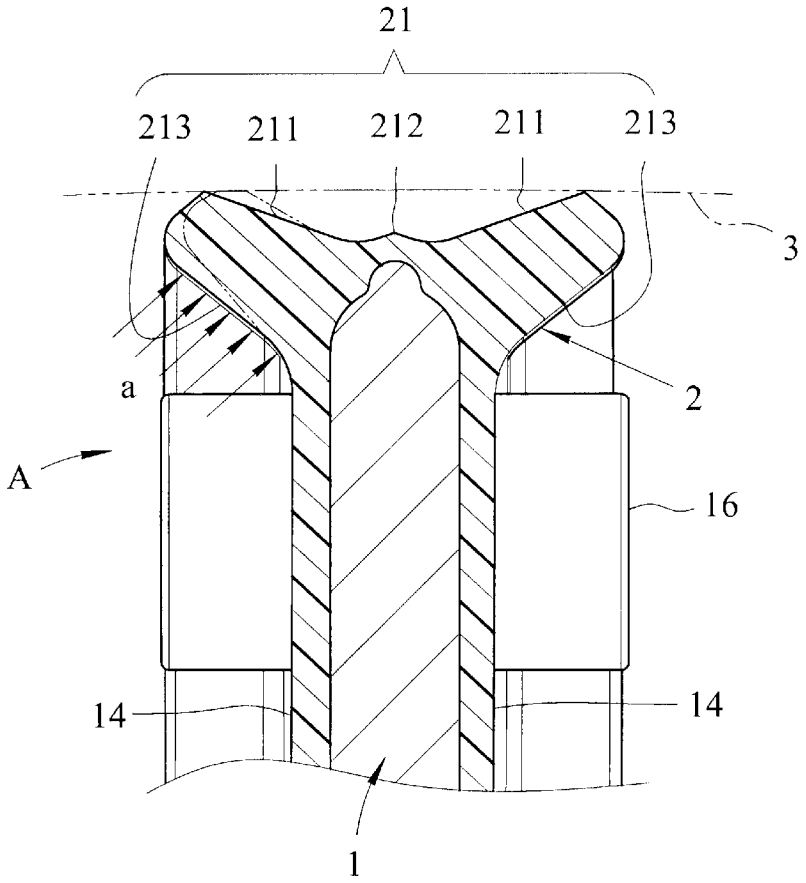
FIG. 6 is a partial cross sectional view to show that the lips of the seal portion of the rotor of the present invention contact the inside of the cylinder.
Figure 7:
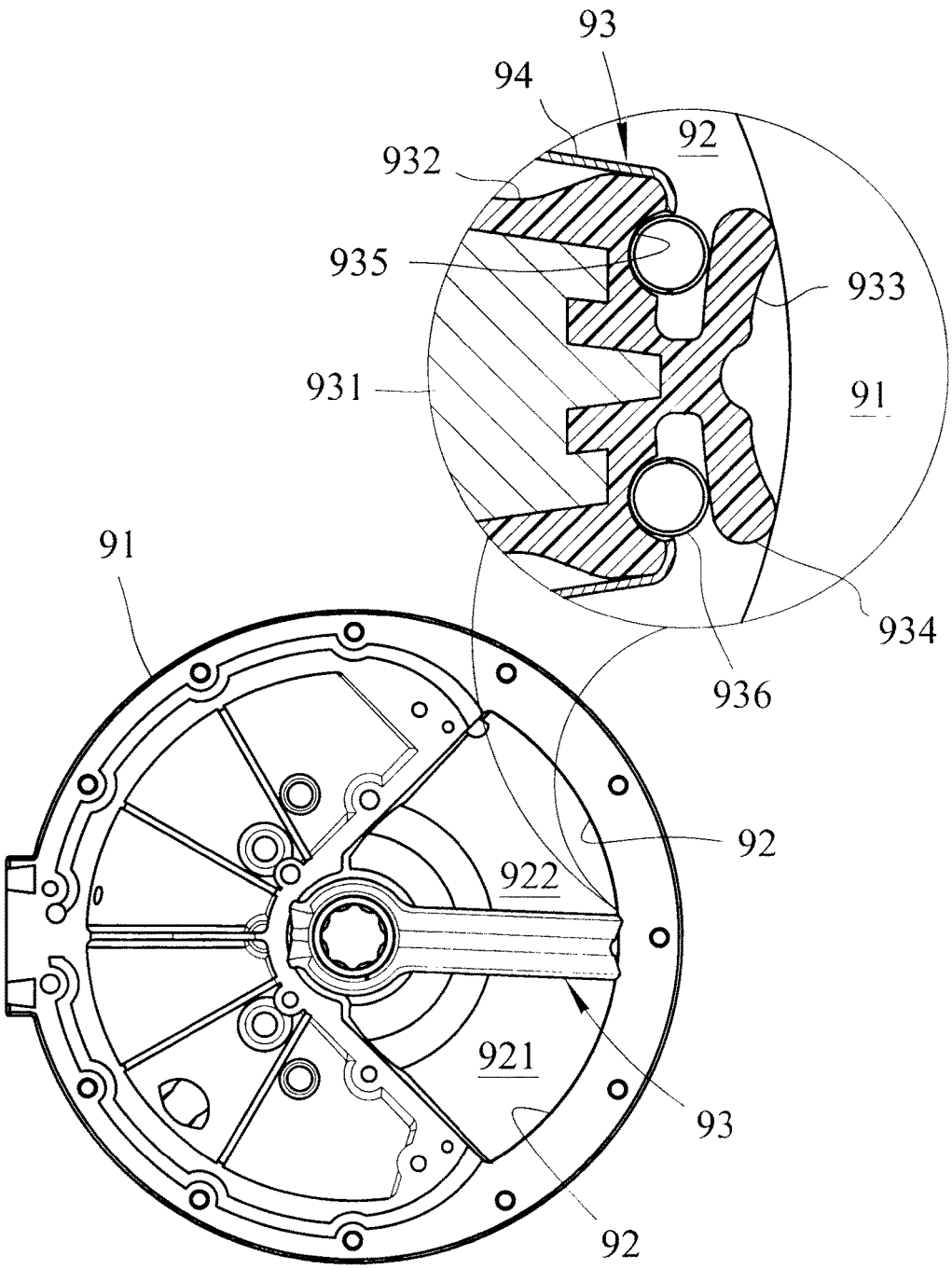
FIG.7 PRIOR ART
FIG. 7 shows that the lips of the seal portion of the conventional rotor contact the inside of the cylinder.
Figure 8:
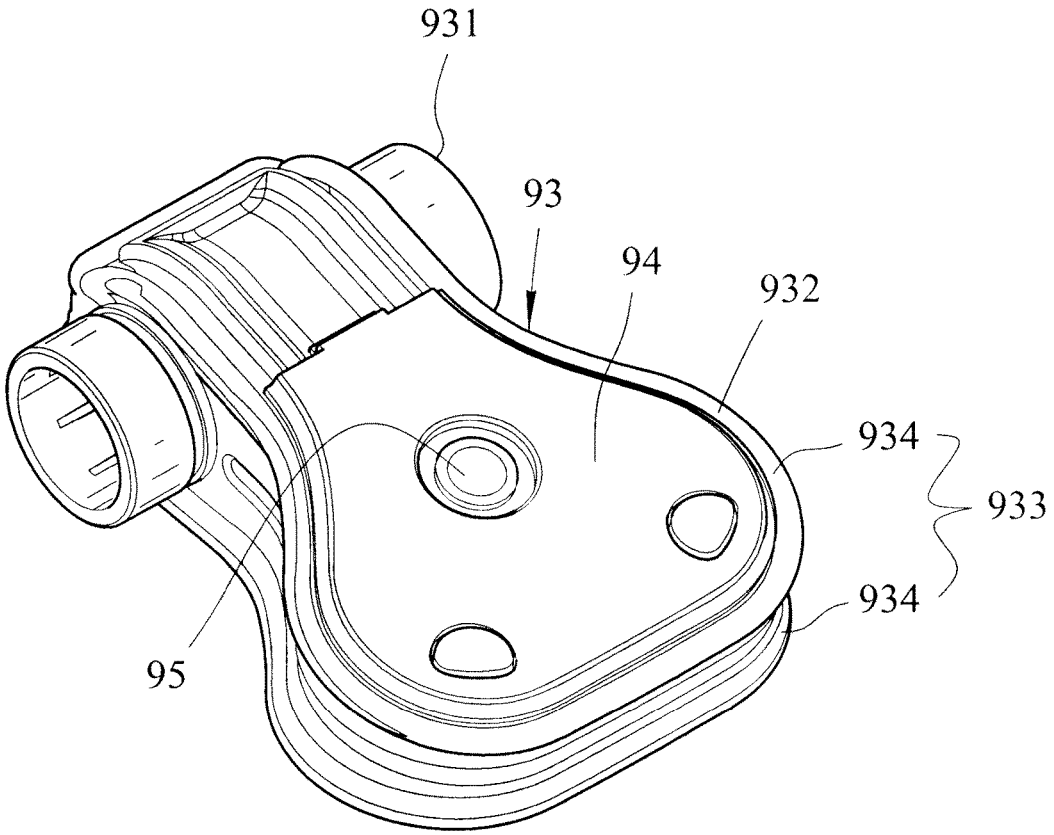
FIG.8 PRIOR ART
FIG. 8 is a perspective view to show the conventional rotor with two lips.
Figure 9:
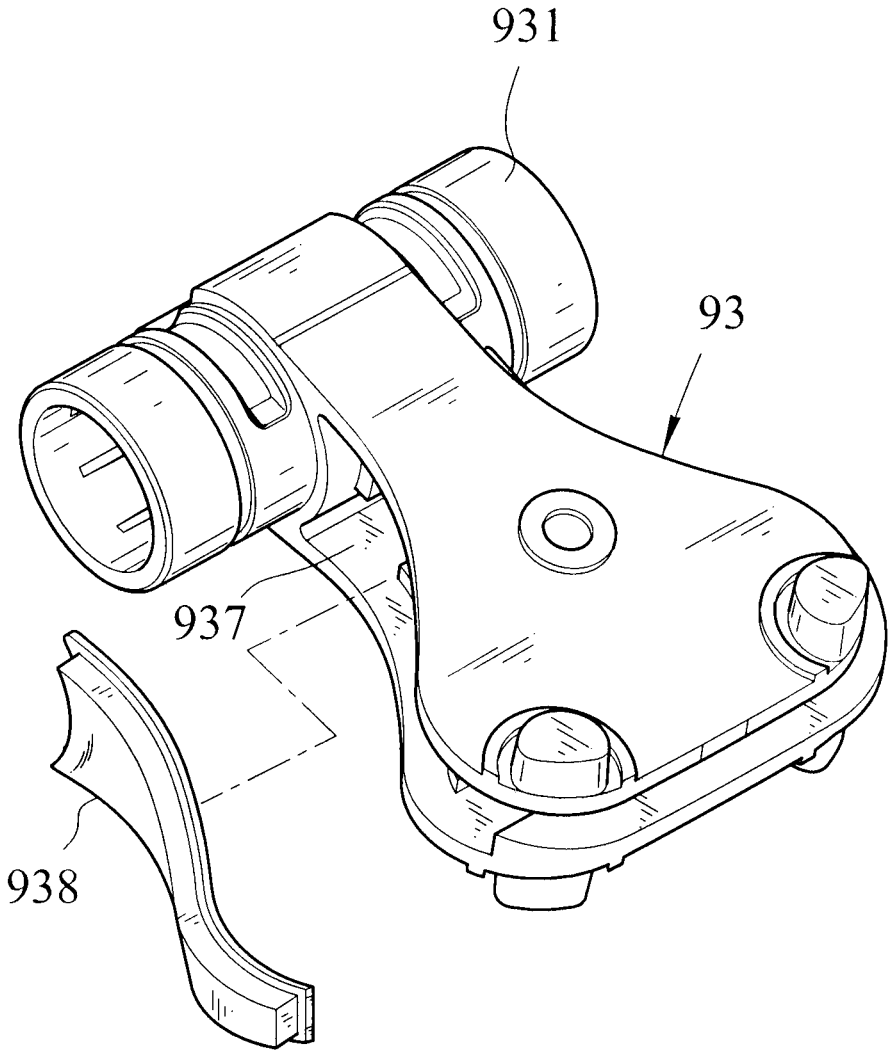
FIG.9 PRIOR ART
FIG. 9 shows that the conventional rotor includes a hollow body and a side panel is to be connected to the open side of the hollow body.

As shown in FIGS. 5 and 6, the rotor "A" is a single piece and the resilient coat 2 is easily coated to the rotor "A" by using a mold set. The lip portion 21 of the rotor "A" has two lips 211 which snugly and rotatably contact the inside 3 of the cylinder when the rotor "A" is rotated within the cylinder by pressure. The direction of the rotation of the rotor "A" is controlled by using an electro-magnetic valve or the like.

The ridge like connection portion 212 reinforces the durability of the seal portion 21. When pressure "a" is applied to the tapered faces 213 of the two lips 211, the pressure "a" assists the seal portion 21 to snugly contact the inside 3 of the cylinder.

While we have shown and described the embodiment in accordance with the present invention, it should be clear to those skilled in the art that further embodiments may be made without departing from the scope of the present invention.

What is claimed is:

1. A rotor for a rotary cylinder, comprising:

a body having a tube and a plate which has a first end integrally formed to the tube, a second end of the plate extending radially relative to the tube, the plate being a solid plate and having a curved outer periphery, a first recessed area defined in each of a top and a bottom of the plate, a waist formed to the plate and located between the first and second ends of the plate, and two protrusions extending from each of the two first recessed areas; and a resilient coat coated to the body and including a Y-shaped seal portion along the curved outer periphery of the plate.

2. The rotor as claimed in claim 1, wherein a length of each of the protrusions is substantially the same as an outer diameter of the tube.

3. The rotor as claimed in claim 1, wherein two second recessed areas are defined in each of the first recessed areas, each of the second recessed areas has one of the protrusions extending therefrom, an area of each of the second recessed areas is larger than a cross sectional area of the protrusion corresponding thereto.

4. The rotor as claimed in claim 1, wherein a rib extending from one of the two first recessed areas.

5. The rotor as claimed in claim 1, wherein a keyway is defined axially in an inside of the tube.

6. The rotor as claimed in claim 1, wherein the tube has two slots defined therein.

7. A rotor for a rotary cylinder, comprising:

a body having a tube and a plate which has a first end integrally formed to the tube, a second end of the plate extending radially relative to the tube, the plate being a solid plate and having a curved outer periphery, a first recessed area defined in each of a top and a bottom of the plate, a waist formed to the plate and located between the first and second ends of the plate; and a resilient coat coated to the body and including a Y-shaped seal portion along the curved outer periphery of the plate, the seal portion including two lips and a connection portion which is connected between the two lips, each lip having a narrow top and a wide root portion, each lip having a tapered face which faces the first recessed area corresponding thereto.

8. The rotor as claimed in claim 7, wherein a ratio between a thickness of the body and an outer diameter of the tube of the rotary is between ¼ to ½.

9. A rotor for a rotary cylinder, comprising:

a body having a tube and a plate which has a first end integrally formed to the tube, a second end of the plate extending radially relative to the tube, the plate being a solid plate and having a curved outer periphery, a first recessed area defined in each of a top and a bottom of the plate, a waist formed to the plate and located between the first and second ends of the plate; and a resilient coat coated to the body and including a Y-shaped seal portion along the curved outer periphery of the plate, a thickness of the resilient coat being between 0.5 mm to 5 mm.

* * * * *